US007658022B2

(12) United States Patent
Strait

(10) Patent No.: US 7,658,022 B2
(45) **Date of Patent: *Feb. 9, 2010**

(54) SLIP HITCH FOR A SNOW PLOW

(75) Inventor: Randy W. Strait, Frankfort, IL (US)

(73) Assignee: Arctic Snow and Ice Control, Inc., Frankfort, IL (US)

( * ) Notice: Subject to any disclaimer, the term of this patent is extended or adjusted under 35 U.S.C. 154(b) by 473 days.

This patent is subject to a terminal disclaimer.

(21) Appl. No.: 11/473,500

(22) Filed: Jun. 26, 2006

(65) Prior Publication Data

US 2006/0288616 A1 Dec. 28, 2006

Related U.S. Application Data

(63) Continuation-in-part of application No. 10/613,313, filed on Jul. 7, 2003, now Pat. No. 7,089,692.

(51) Int. Cl.
*E01H 5/04* (2006.01)
*E01H 5/06* (2006.01)

(52) U.S. Cl. ..... 37/232; 37/274; 37/281

(58) Field of Classification Search ..... 37/233, 37/274, 236, 275, 231, 232, 280, 281; 414/723
See application file for complete search history.

(56) References Cited

U.S. PATENT DOCUMENTS 1,624,839 A * 4/1927 Lombard ..... 37/274
3,772,803 A * 11/1973 Cote ..... 37/233
3,845,577 A * 11/1974 Naymik ..... 37/231
4,106,645 A * 8/1978 Janish ..... 414/723
4,962,600 A * 10/1990 Zellaha et al. ..... 37/280
5,375,349 A * 12/1994 Jochim ..... 37/429
5,437,113 A * 8/1995 Jones ..... 37/233
6,240,660 B1 * 6/2001 Dugas ..... 37/280
6,363,631 B1 * 4/2002 Cordingley ..... 37/280
6,823,615 B2 * 11/2004 Strait ..... 37/233
2005/0126051 A1 * 6/2005 Fatemi ..... 37/266

FOREIGN PATENT DOCUMENTS

DE 4041846 A1 * 6/1992

* cited by examiner

*Primary Examiner*—Thomas B Will
*Assistant Examiner*—Abigail A Risic
(74) *Attorney, Agent, or Firm*—Davis M. Chin, Jr.; Davis Chin

(57) ABSTRACT

A slip hitch connection to a drive vehicle for a snow plow comprises an elongated flat planar member that can be hooked on to a connecting lug of the drive vehicle, the flat planar member being mounted on the snow plow frame for reciprocal movement in each of a pair of spaced apart coupling assemblies secured to the snow plow frame for connecting the snow plow to the drive vehicle. Each of the elongated flat planar members have an upper and lower elongated guide slot in which guide bolts that move up and down as the snow plow itself is moved up and down are received to enable the guide bolts and snow plow to which they are connected make limited reciprocal movement up and down while hooked up to the drive vehicle and being pushed forward during a snow plowing operation. This enable the snow plow to move rearwardly and upwardly enough to clear an object hit by the leading edge of the snow plow on the ground and then to reciprocate forwardly and downwardly to its original position after passing over the obstacle.

5 Claims, 12 Drawing Sheets

SLIP HITCH FOR A SNOW PLOW

CROSS-REFERENCE TO RELATED APPLICATION

The present invention is a continuation-in-part application based on prior application Ser. No. 10/613,313 filed on Jul. 7, 2003, now U.S. Pat. No. 7,089,692 and entitled "Slip Hitch for a Snow Plow."

BACKGROUND OF THE INVENTION

1. Field of the Invention

This invention relates to the field of hitches or coupling assemblies that connect a snow plow or other comparable items to drive vehicles, and in particular to one in which the snow plow can momentarily release or slip over a blocking object it encounters as it is moved along the ground during its snow plowing operation, and then return to its original working position after it has passed over the blocking object. It also relates to a slip hitch for a snow plow or other comparable items that enable the snow plow or other comparable items to adjust to the incline and decline of the surface being plowed or scraped.

2. Description of the Prior Art

The typical prior art hitches or coupling assemblies for snow plows that connect to a drive vehicle have a rigid non-release mechanism. When a blocking object is encountered on the ground, the only way for such prior art connections of a snow plow to a drive vehicle to get over the obstacle is for the operator to manually operate the lifting and lowering mechanism of the coupling assembly to raise the snow plow that way, then drive past the obstacle and then manually operate the lifting and lowering mechanism to lower the snow plow back on to the ground.

SUMMARY OF THE INVENTION

The hitch or coupling assembly in accordance with the present invention includes an elongated slip hitch operating member that hooks on to the connecting lug of the drive vehicle coupling apparatus, in which the slip hitch operating member has one or more elongated guide slots to receive corresponding guide rods or bolts that are connected to members that are in turn connected to the snow plow. When the snow plow encounters an obstacle on the ground, the lower edge of the snow plow is urged rearwardly which puts rearward pressure on the guide rods in the guide slots of the slip hitch operating member causing them to ride upwardly as the guide rods move upwardly in the guide slots until the snow plow is able to clear the obstacle, after which the guide rods slide back down in the guide slots as the snow plow is lowered by gravity back to its original operating position in contact with the ground.

The foregoing applies specifically to the disclosure of the parent application Ser. No. 10/613,313. A second embodiment of the snow plow of the present invention added by way of this continuation-in-part application is quite similar to the one as shown in FIGS. 1 and 5, except that the wing plate assembly therein has been modified so as to increase the wing plate assembly length and to include a back support bracket requiring an additional slot on the aft of the wing plate assembly. As a result, this second added embodiment represents an improvement over the embodiment of FIGS. 1 and 5 since it has the capability of also capturing snow in the reverse direction as well as in the forward direction of travel. Additionally, this second embodiment also reduces the amount of force applied to the aft of the wing plate assembly when the snow plow is fully filled with snow.

Further, a third embodiment of the snow plow of the present invention also added by way of this continuation-in-part application is quite similar to the one illustrated in FIGS. 1-4, except that the hitch or coupling assembly therein has been modified so as to include a universal adjustable slide mount for the slip hitch. As a result, this third embodiment represents an improvement over the present invention since it accommodates all of the different manufactures' boom spread size.

Moreover, a fourth embodiment of the snow plow the present invention also added by way of this continuation-in-part application includes a hinged torsion-spring trip cutting edge so as to allow the moldboard assembly thereof to flex upwardly when an obstacle is encountered by the cutting edge. As a result, the block members that connect the snow plow frame to the moldboard are prevented from being damaged or destroyed.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
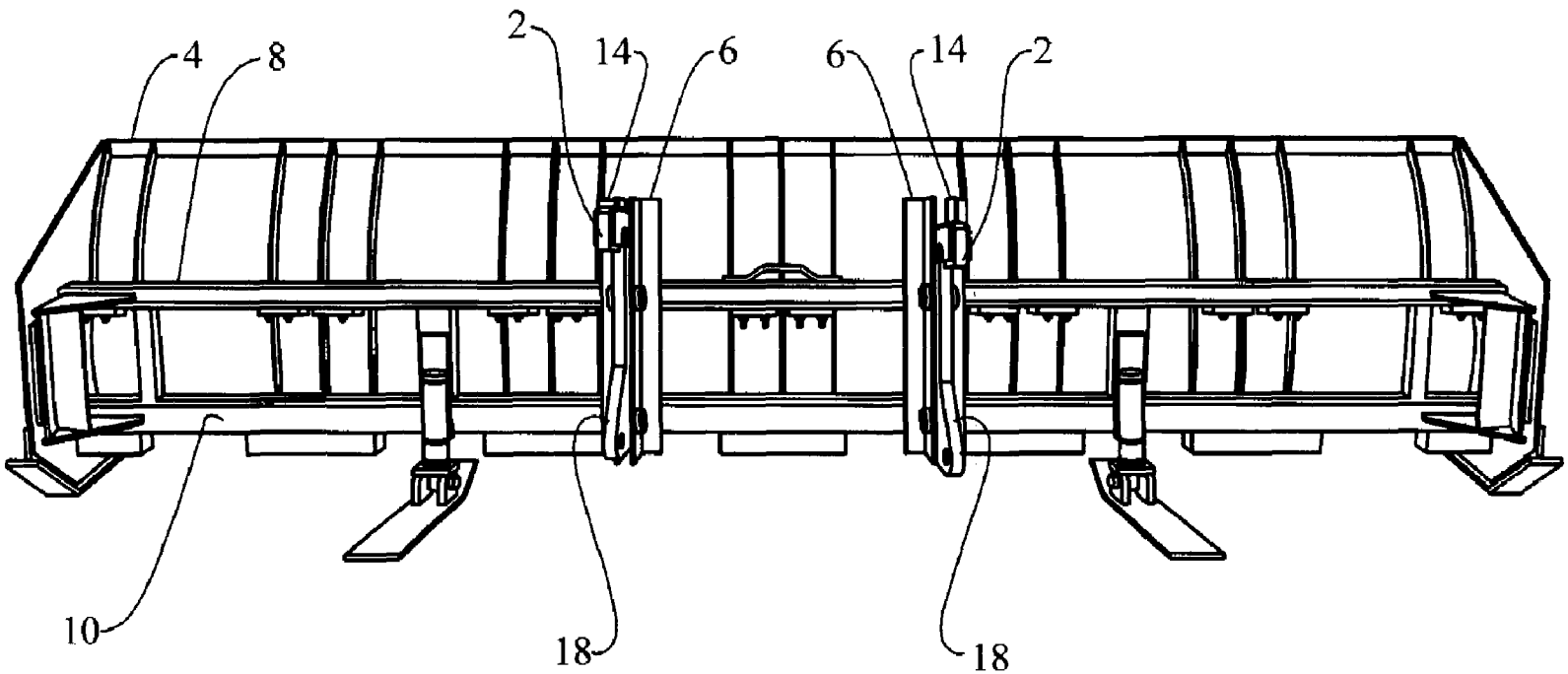
FIG. 1 is an elevation view of the rear of a snow plow having a pair of spaced apart slip hitch connecting members for connection to a drive vehicle.
Figure 2:
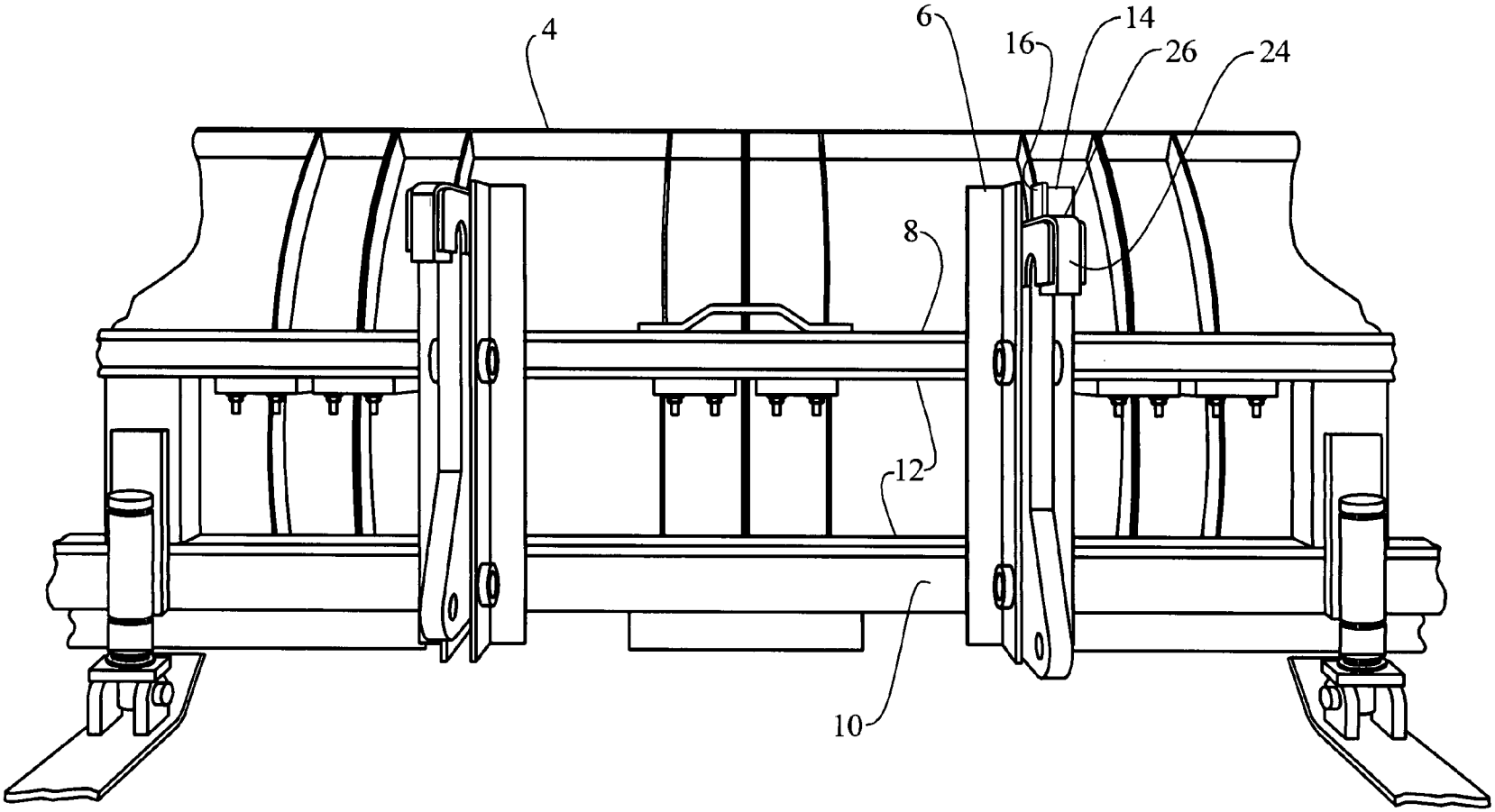
FIG. 2 is an enlarged elevation view of the mid-portion of the rear of the snow plow seen in FIG. 1 to better illustrate the pair of spaced apart slip hitch connecting members.
Figure 3:
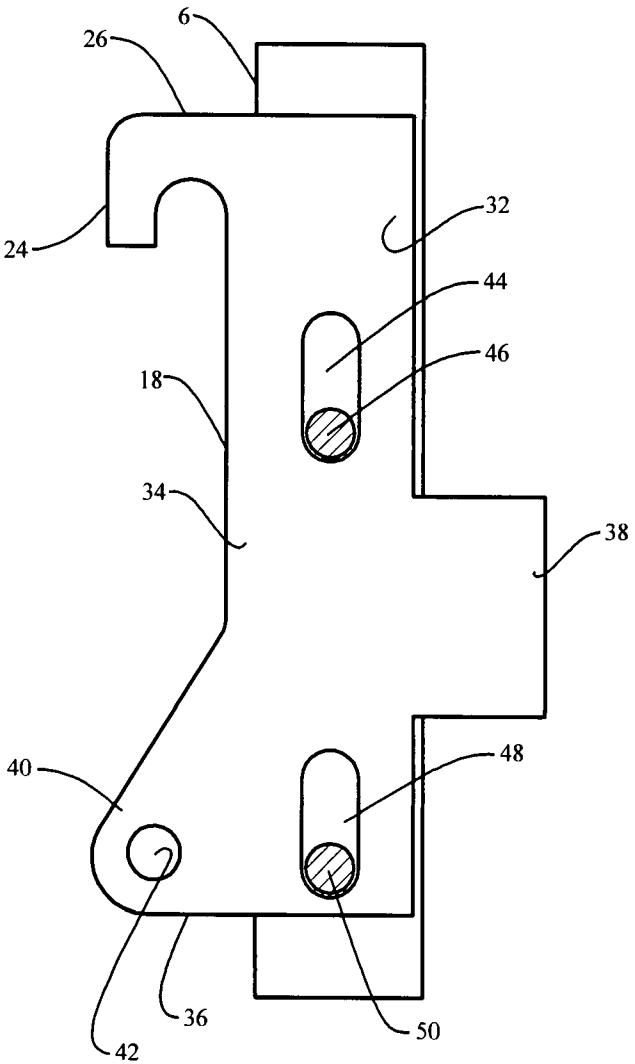
FIG. 3 is an elevation view of the elongated slip hitch member mounted for limited reciprocal movement relative to the vertical mounting bars between which it is positioned, one of the vertical mounting bars being broken away to better illustrate the slip hitch member, and showing upper and lower guide rods in section in their respective guide slots of the slip hitch member.
Figure 4:
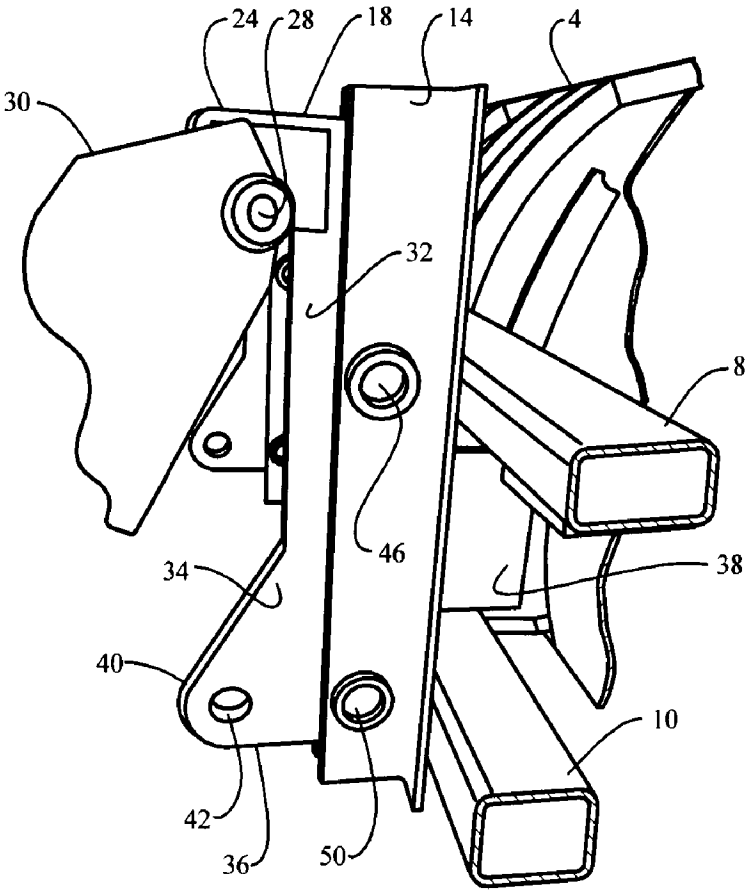
FIG. 4 is an elevation view of a portion of the side of a snow plow having slip hitch connecting members and also of a portion of the side of a connecting member of a drive vehicle in position to connect to the slip hitch connecting members.
Figure 5:
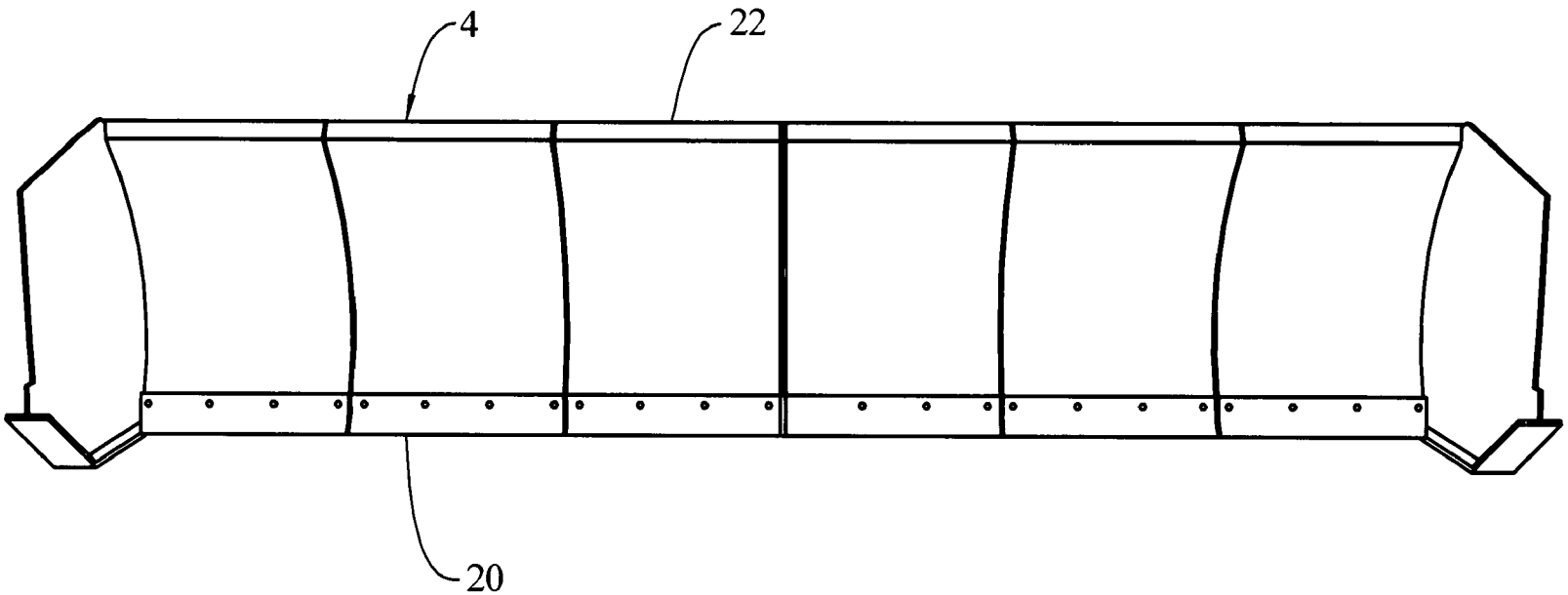
FIG. 5 is an elevation view of the front of the snow plow seen in FIG. 1.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

A slip hitch connecting assembly in accordance with the present invention includes a pair of spaced apart vertical connecting members 2 welded or otherwise secured to the back of a snow plow 4 or other item of equipment that is hitched to a drive vehicle for performing a work function on the surface of the ground as it is moved forward by the drive vehicle. The snow plow 4 shown and described herein has a sectioned moldboard which is the subject of a separate co-pending patent application Ser. No. 10/057,269 filed in the United States Patent and Trademark Office on Jan. 28, 2002 by the same inventor, and has now matured into U.S. Pat. No. 6,823,615 issued on Nov. 30, 2004, but the slip hitch connecting assembly in accordance with this invention can be used with other snow plows and similar equipment as well.

Each vertical connecting member 2 is identical so only one need be described in detail. Each includes a first upright bar 6 welded or otherwise secured to the upper horizontal frame bar 8 and lower horizontal frame bar 10 of the snow plow frame 12 which extend across the rear of the snow plow 4. Each vertical connecting member 2 also includes a second upright bar 14 which is also welded or otherwise secured to the horizontal frame bars 8 and 10 at a location slightly spaced apart horizontally from the first upright bar 6 to provide a through channel 16 between the vertical 6 and 14.

An elongated slip hitch member 18 is received in the through channel 16 for limited reciprocal movement relative to the upright bars 6 and 14 which form the side walls of the channel 16 when the lower edge 20 of the snow plow 4 contacts an item projecting upwardly from the ground causing the upper edge 22 of the snow plow to tip forwardly and upwardly in a limited arcuate path as the lower edge 20 is moved rearwardly and upwardly enough to clear the upwardly projecting item. The upright bars 6 and 14 then slide downwardly relative to the elongated slip hitch member 18 enabling the upper edge 22 and lower edge 20 of the snow plow 4 to move back to their original positions, the lower edge sliding downwardly and forwardly into scraping contact with the ground, the upper edge sliding downwardly and rearwardly in a slight arcuate path.

The slip hitch member 18 includes a connecting hook member 24 formed at its upper end 26 facing rearwardly to receive the connecting lug 28 of a drive vehicle coupling assembly 30. The slip hitch member 18 includes an integrally formed upper flat planar section 32 extending downwardly about eighteen inches from the hook member 24. The slip hitch member 18 also includes a lower flat planar section 34 which extends another eight inches or so downward to terminate in a hitch member lower edge 36. A flat planar abutment member 38 is integrally formed to extend forwardly of the slip hitch member 18 and between the upper horizontal frame bar 8 and lower horizontal frame bar 10 of the snow plow 4 when the slip hitch connecting assembly and its slip hitch member 18 are in place on the snow plow 4.

The lower flat planar section 34 has an integrally formed connecting projection 40 extending rearwardly, having a connecting aperture 42 to receive the connecting pin of a drive vehicle coupling assembly 30. The elongated slip hitch member 18 is able to pivot slightly to the rear on the connecting pin in aperture 42 when the lower edge 20 of the snow plow encounters an obstacle on the ground. That in turn puts rearward pressure on the slip hitch member 18 causing it to pivot slightly to the rear as guide rod members connected to the snow plow slide upwardly and slightly to the rear in guide slots of the slip hitch member as the snow plow is moved rearwardly and upwardly to clear the obstacle. When the obstacle is cleared, the snow plow is free to fall back to its original position by gravity, causing the guide rod members to slide down in their respective guide slots of the slip hitch member to guide the snow plow to its original working position with its lower edge 20 in scraping contact with the ground to resume plowing snow.

The slip hitch member 18 includes an upper elongated guide slot 44 to receive an upper reciprocating guide rod or bolt 46 which extends across from the spaced apart upright bars 6 and 14 that are welded to the horizontal frame bars 8 and 10 of the snow plow frame 12 at the level of the upper frame bar 8. The slip hitch member 18 also includes a lower elongated guide slot 48 to receive a lower reciprocating guide rod or bolt 50 which extends across from the spaced apart upright bars 6 and 14 at the level of the lower horizontal frame bar 10. When the lower edge 20 of the snow plow 4 contacts an item projecting upwardly from the ground causing the upper edge 22 of the snow plow to tip forwardly and upwardly in a limited arcuate path as the lower edge 20 is moved rearwardly and upwardly enough to clear the upwardly projecting item, the guide bolts 46 and 50 move upwardly in their respective elongated guide slots 44 and 48. When the lower edge 20 of the snow plow has cleared the upwardly projecting item, the snow plow is then free to move downwardly by gravity to its original operating position whereby the guide bolts 46 and 50 move in a reciprocating manner downward in their respective guide slots 44 and 48.

The elongated slip hitch member 18 is able to pivot slightly to the rear on the connecting pin in aperture 42 when the lower edge 20 of the snow plow encounters an obstacle on the ground that in turn puts rearward pressure on the guide rods 46 and 50 in their respective guide slots 44 and 48 of the slip hitch member 18 causing it to pivot slightly to the rear as the guide rods slide upwardly and slightly to the rear in their guide slots 44 and 48 as the snow plow is moved rearwardly and upwardly to clear the obstacle.

In view of the foregoing detailed description, it can thus be seen that the present invention provides a slip hitch for connection to a drive vehicle for a snow plow which includes an elongated flat planar member for hooking onto a connecting lug of the drive vehicle. The flat planar member is mounted on the snow plow frame for reciprocal movement in each of a pair of spaced apart coupling members secured to the snow plow frame for connecting the snow plow to the drive vehicle.

The wing plate assembly of the first embodiment suffered from the disadvantage of being only able to capture snow when the snow plow is moved in a forward direction and could not capture snow in the reverse direction. Also, the slip hitch of the first embodiment being secured fixedly to one portion of the snow plow frame could not accommodate wheel loaders of different manufactures having varied boom spread sizes. In addition, the cutting edge of the snow plow of the first embodiment being mounted directly to the moldboard thereof did not offer sufficient flexibility when an obstacle was encountered which resulted in damage to the block members of the snow plow.

In order to overcome each and every one of these problems, the wing plate assembly, snow plow frame and cutting edge of the snow plow have been modified. A second embodiment of the snow plow is described and illustrated in FIGS. 6 though 8 of the drawings. A third embodiment of the snow plow is described and illustrated in FIGS. 9 and 10 of the drawings. A fourth embodiment of the snow plow is described and illustrated in FIGS. 11 and 12 of the drawings.

Figure 6:
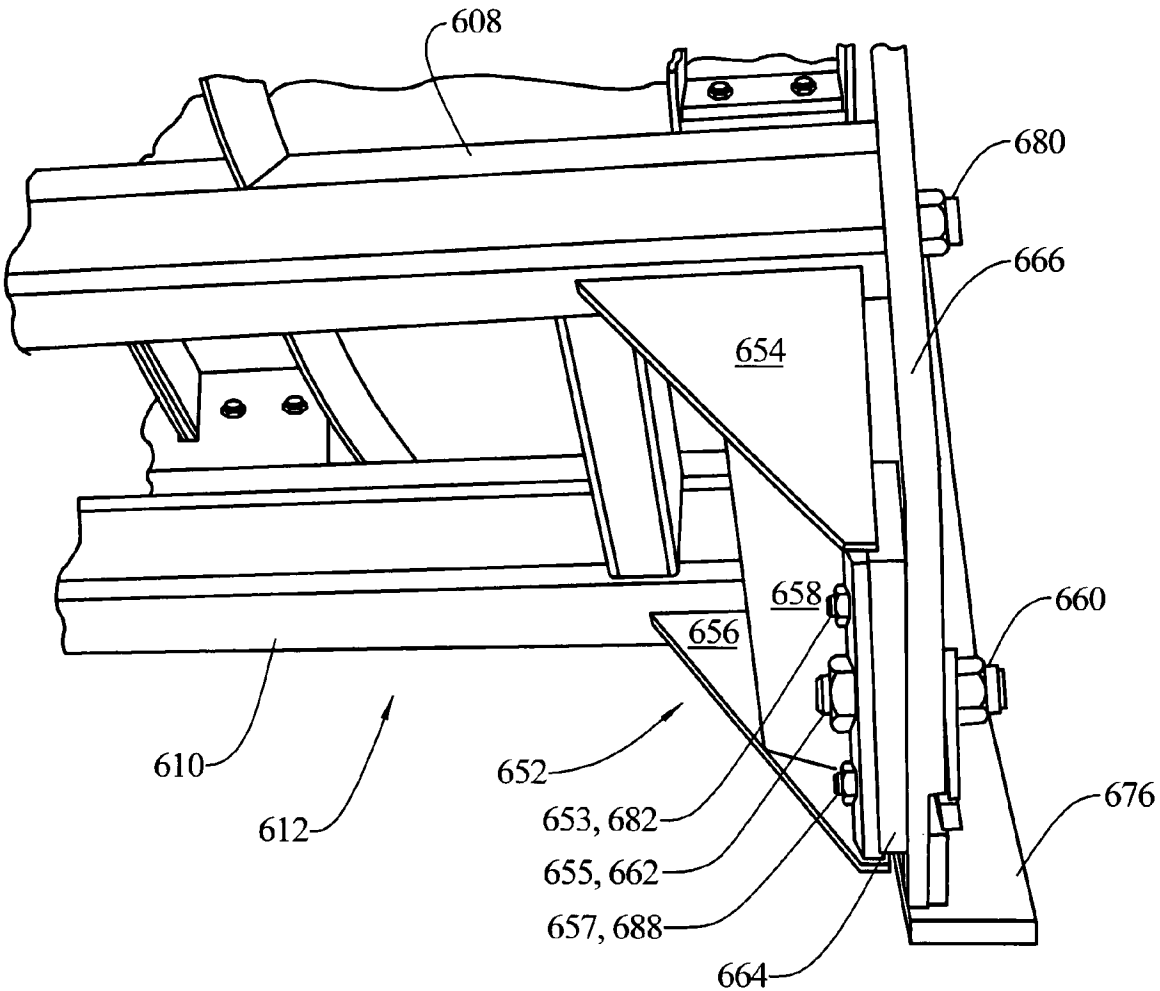
FIG. 6 is a second embodiment of a snow plow of the present invention, ilustrating the back view of a portion of the wing plate assembly with back support bracket.
Figure 7:
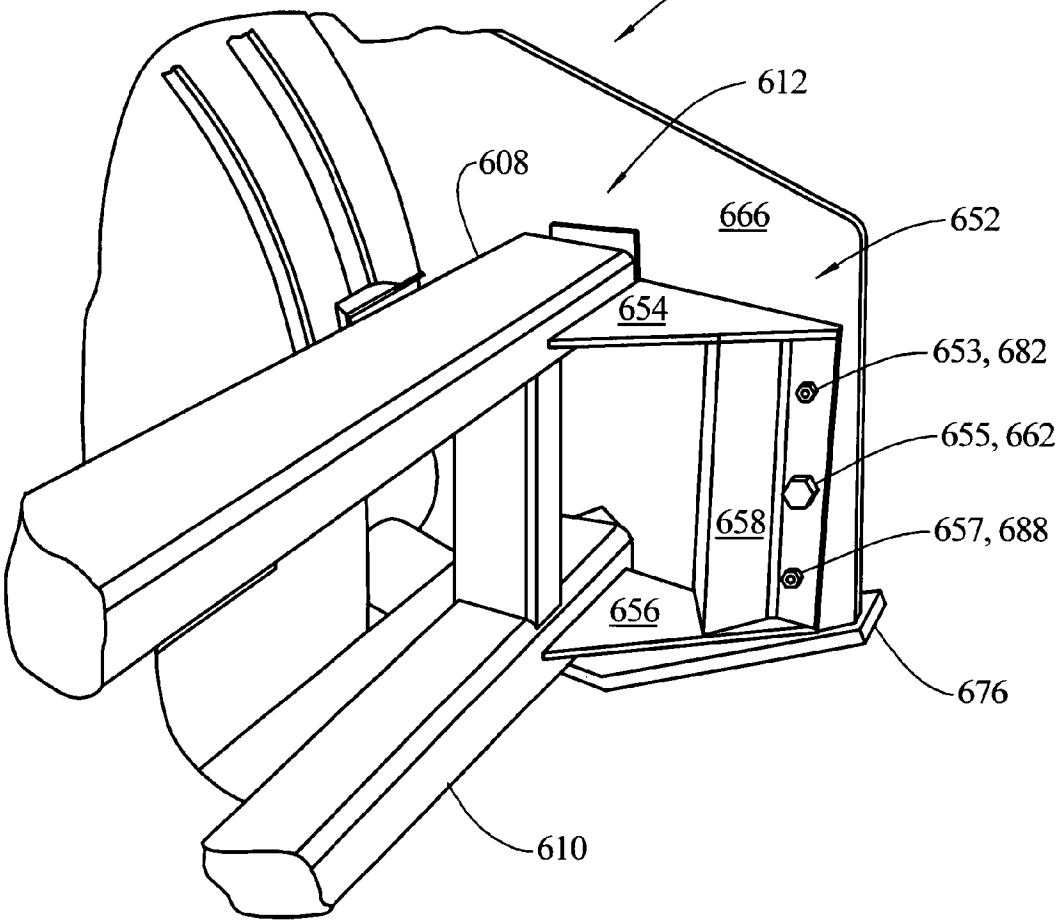
FIG. 7 is an enlarged, perspective view of the back support bracket of FIG. 6.
Figure 8:
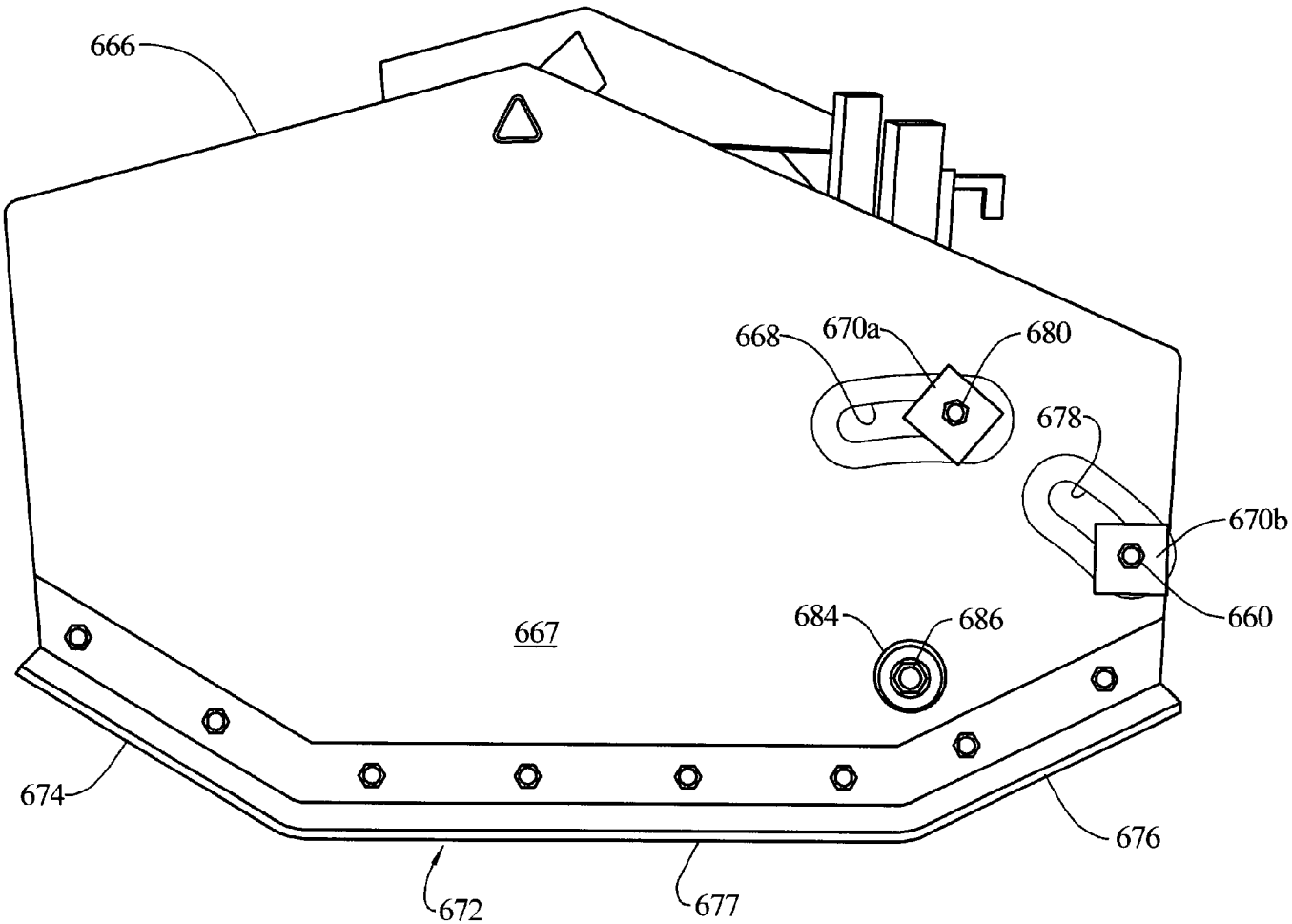
FIG. 8 is a side view of the wing plate assembly, in accordance with the present invention.

Specifically, in FIGS. 6-8, there is illustrated a second embodiment directed to a wing plate assembly which includes a back support bracket 652 of the present invention. The back support bracket 652 consists of a top triangular-shaped member 654 and a bottom triangular-shaped member 656, both of which are identical in shape and size. An L-shaped member 658 is welded in between the top triangular-shaped member 654 and the bottom triangular-shaped member 656. The L-shaped member 658 includes three vertically aligned apertures 653, 655, 657.

The back support bracket 652 is welded to the snow plow frame 612. More specifically, the top triangular-shaped member 654 of the back support bracket 652 is welded to the upper horizontal frame bar 608 of the snow plow frame 612 and the bottom triangular-shaped member 656 of the back support bracket 652 is welded to the lower horizontal frame bar 610 of the snow plow frame 612. The back support bracket 652 functions to reduce the amount of force applied to the aft of the wing plate assembly when the snow plow is fully filled with snow.

Furthermore, the snow plow 604 includes a first wing plate member 666 mounted for limited pivotal movement at one side thereof, and a second wing plate member 667 mounted for limited pivotal movement at the opposite side thereof. Each wing plate member 666, 667 includes a first arcuate slot 668, a second arcuate slot 678 and a circular opening 684, all of which are located on the aft portion of the wing plate members. Secured to the lower portion of each wing plate member is a skid shoe 672. The skid shoe 672 includes a flat portion 677, an upwardly inclined forward portion 674 and an upwardly inclined back portion 676. Since each wing plate member 666, 667 is secured to the snow plow frame 612 and the back support bracket 652 in the same manner, the description of securing only one wing plate member will now be explained in detail.

The wing plate member 666 is secured to the snow plow frame 612 by a first bolt and washer combination 680, the bolt extending through a first retaining plate 670*a*, the first arcuate slot 668 and threaded into a threaded tap opening to the outer end of the upper horizontal frame bar 608, and a second bolt and washer combination 686, the bolt extending through circular opening 684 in the lower, aft portion of the wing plate member 666 and threaded into a threaded tap opening to the outer end of the lower horizontal frame bar 610.

Furthermore, the wing plate member 666 is also secured to the back support bracket 652. Placed between the wing member 666 and the back support bracket 652 is a nylon spacer 664. The nylon spacer 664 includes three vertically aligned apertures which correspond and align with the apertures 653, 655, 657 located on the L-shaped member of the back support bracket 652. The nylon spacer 664 is secured to the back support bracket 652 by a first nut and bolt combination 682 and a second nut and bolt combination 688 inserted through the first aperture 653 and the third aperture 657 of the L-shaped member 658, respectively. Wing plate member 666 is secured to the back support bracket 652 by a bolt 662 and nut 660, the bolt extending through a second retaining plate 670*b*, the second arcuate slot 678, the middle aperture in the nylon spacer 664, the second aperture 655 in the L-shaped member 658 of the back support bracket 652 and threaded into nut 660.

In operation, as a vehicle moves the snow plow forward, the first arcuate slot 668 and the second arcuate slot 678 permit the wing member 666, as the case may be, a limited amount of pivotal movement around the respective bolts 680, 662 at the lower, aft portion of the wing member 666 as the skid shoe 672 on the bottom edge of the wing plate member 666 rises and falls with the contour of the surface on which it is sliding. The skid shoe 672 includes an upwardly inclined forward portion 674 to initially contact a rise in the surface on which the snow plow is being used, to thereby pivot the wing plate member upwardly a limited amount and do so automatically to prevent gouging into an upwardly rising ground surface without the need for action or special attention on the part of the operator of the vehicle snow plow. Additionally, the skid shoe 672 also includes an upwardly inclined back portion 676 to facilitate in removing snow when the vehicle is moving in a reverse direction of travel.

Figure 9:
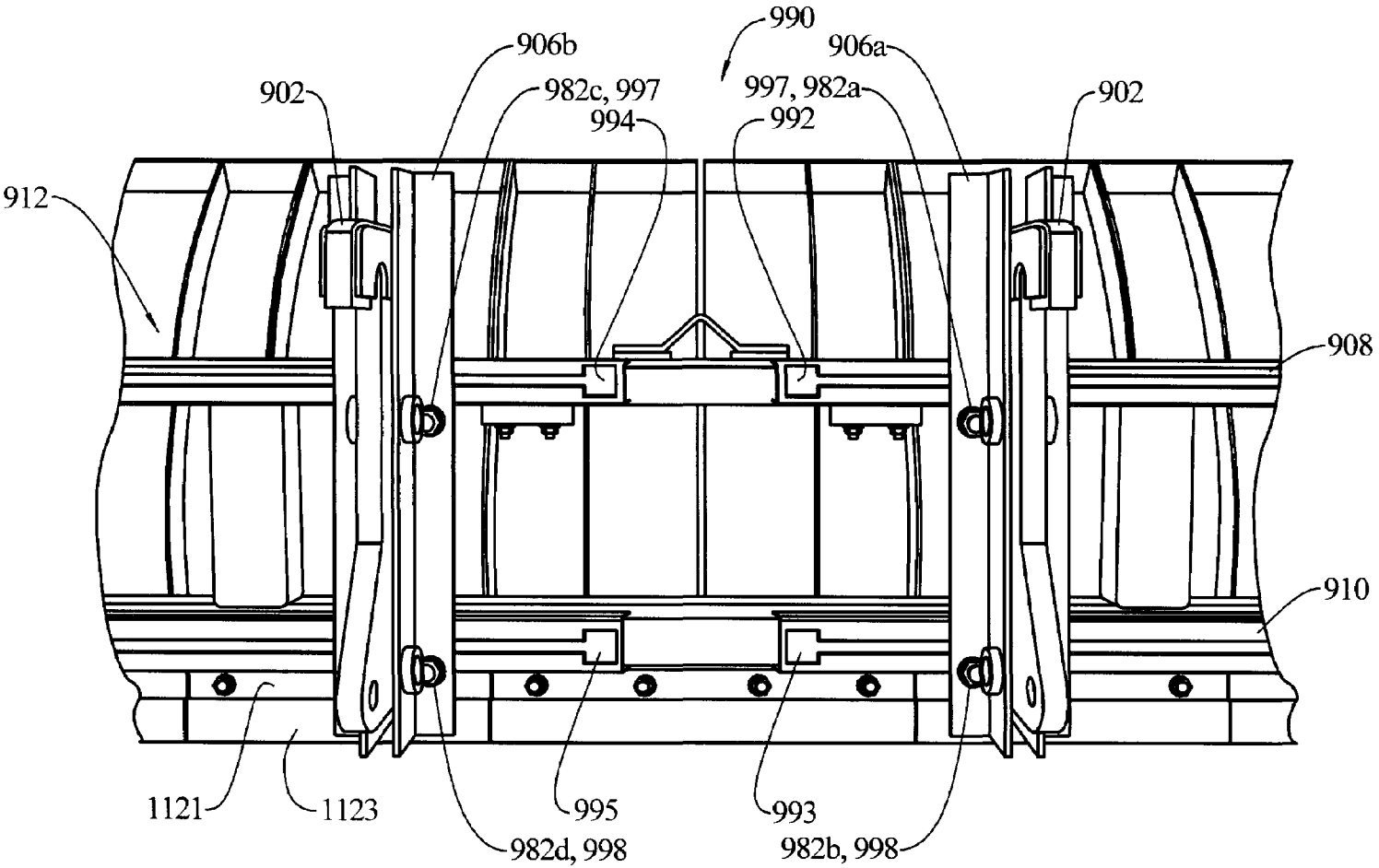
FIG. 9 is a third embodiment of a snow plow of the present invention, illustrating the universal adjustable slide mount on the mid-portion of the rear thereof.
Figure 10:
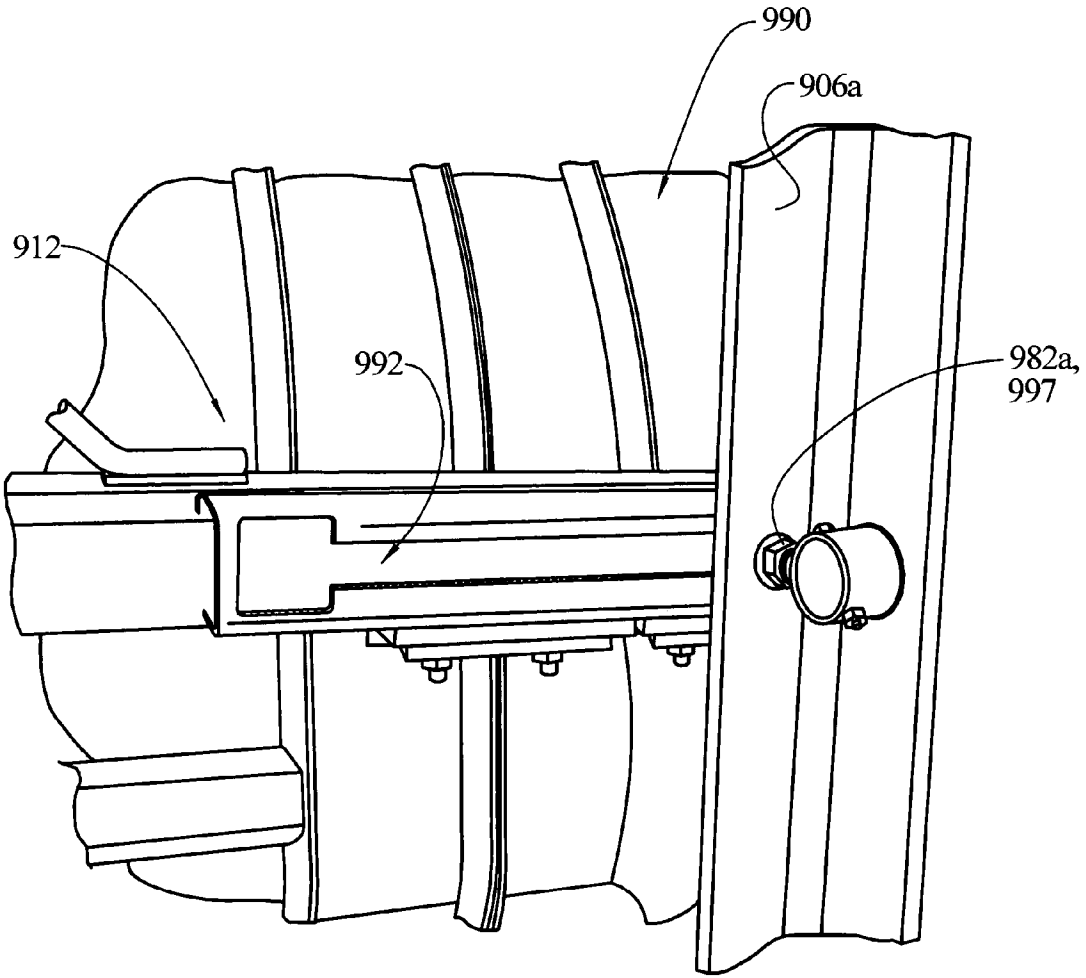
FIG. 10 is an enlarged perspective view of a portion of the universal adjustable slide mount of FIG. 9.

In FIGS. 9 and 10, there is illustrated a third embodiment of a snow plow which includes a universal adjustable slide mount 990 of the present invention. The hitch or coupling assembly of this third embodiment includes a pair of spaced apart vertical connecting members 902. Each vertical connecting member 902 is identical so only one need be described in detail. All of the elements and interconnections of each of the vertical connecting members 902 in the third embodiment of FIGS. 9 and 10 are identical to the ones used in each of the vertical connecting members 2 of FIGS. 1-4, except that first and second upright bars 906*a* and 906*b* each includes a top and bottom aperture 997,998 spaced equal to the distance between the upper horizontal frame bar 908 and the lower horizontal frame bar 910. To the extent that the rest of the elements and interconnections of each of the vertical connecting members 902 are identical to the ones in each of the vertical connecting members 2 (in FIGS. 1-4), the elements and interconnections of each of the vertical connecting members 902 will not be explained any further as it is fully discussed above.

This third embodiment creates an alternative way to secure each of the vertical connecting members 902 to the snow plow frame 912 by way of a universal adjustable slide mount 990. The universal adjustable slide mount 990 includes first and second upper slotted steel channels 992,994 welded or otherwise secured to the upper horizontal frame bar 908 at a location slightly spaced apart horizontally from one another and first and second lower slotted steel channels 993,995 welded or otherwise secured to the lower horizontal frame bar 910 at a location slightly spaced apart horizontally from one another, and having the first slotted steel channels 992,993 vertically aligned with each other and the second slotted steel channels 994,995 vertically aligned with each other.

Further, the first upright bar 906*a* of the vertical connecting member 902 is secured to the snow plow frame 912 by using a nut and bolt combination 982*a* through the top aperture 997 of the first upright bar 906 and the first upper slotted steel channel 992. The first upright bar 906 is also secured to the snow plow frame 912 by using another nut and bolt combination 982*b* through the bottom aperture 998 of the first upright bar 906 and the first lower slotted steel channel 993.

In a similar fashion, the second upright bar 906*b* is secured to the snow plow frame 912 by using a nut and bolt combination 982*c* through the top aperture 997 of the second upright bar 906*b* and the second upper slotted steel channel 994. The second upright bar 906*b* is also secured to the snow plow frame 912 by using another nut and bolt combination 982*d* through the bottom aperture 998 of the second upright bar 906*b* and the second lower slotted steel channel 995.

In operation, the universal adjustable slide mount 990 allows the user to manually adjust inwardly and outwardly the spread size of the hitch or coupling assembly so as to accommodate all of the different manufacturers' boom spread sizes. This is achieved by loosening bolts 982*a-d* and then sliding each of the vertical connecting members 902 along the respective slotted steel channels 992-995 to the desired spread size. Thereafter, retightening of the bolts 982*a-d* is performed so as to secure fixedly the hitch assembly in the new position.

Figure 11:
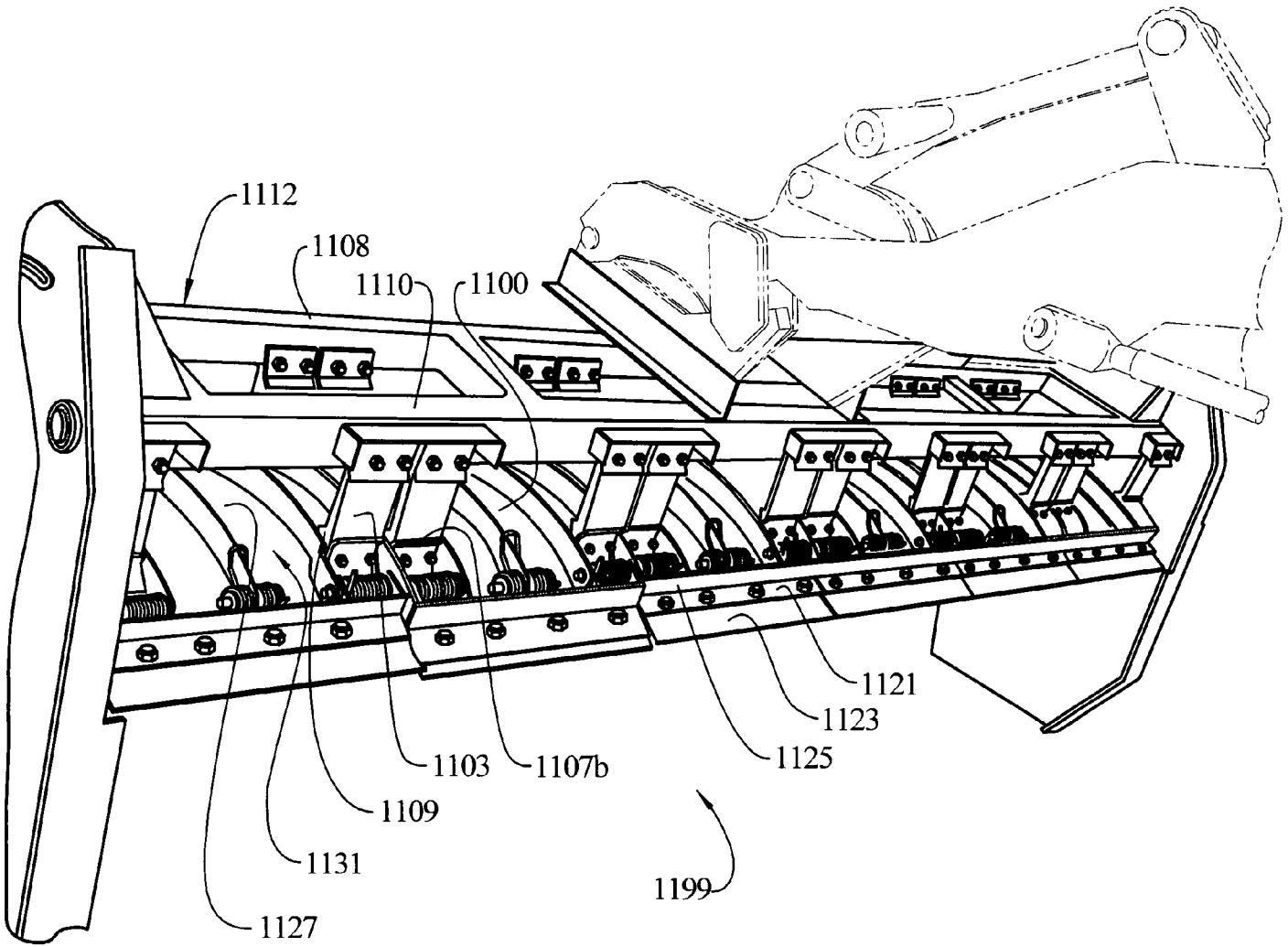
FIG. 11 is a fourth embodiment of a snow plow of the present invention, illustrating a perspective view of the torsion spring trip edge.
Figure 12:
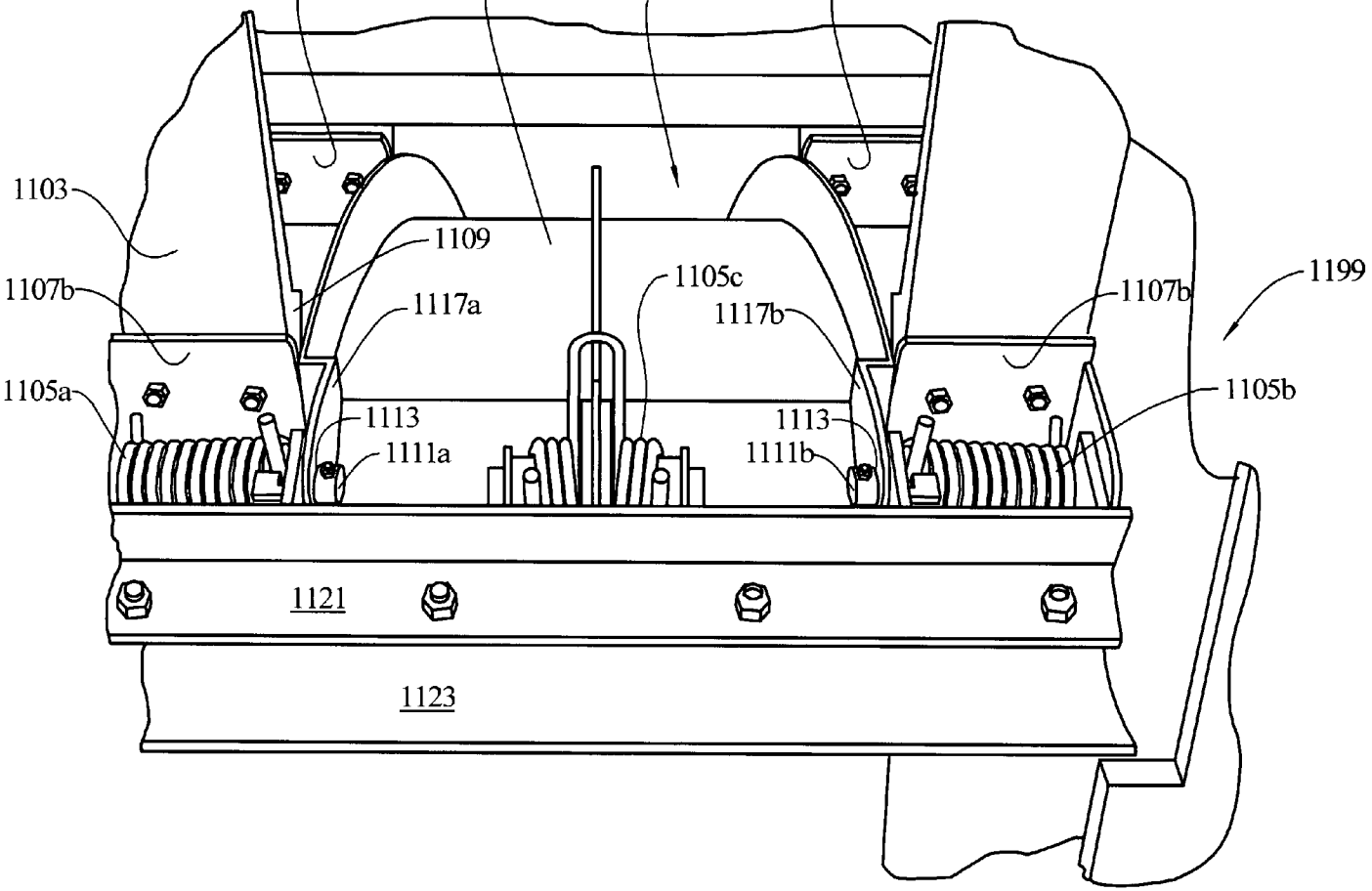
FIG. 12 is an enlarged perspective view of a portion of the rear of the snow plow of the present invention of FIG. 11.

In FIGS. 11 and 12, there is illustrated the fourth embodiment of a snow plow which includes a hinged torsion-spring trip cutting edge assembly 1199. The sectioned moldboard 1100 comprises a plurality of independently movable snow plow sections 1125, arranged in a side-by-side relationship, mounted on a snow plow frame 1112 in such a way that each section 1125 can independently move upwardly and downwardly with the changing contour of the ground surface. Each snow plow section 1125 is secured to the horizontal bars 1108, 1110 of the snow plow frame 1112 by flexible polyurethane block members 1103.

Each snow plow section 1125 comprises a curved or arcuate moldboard 1127, made of steel or other comparably hard and rigid material, having a forwardly facing concave surface (hidden) and a rearwardly facing convex surface 1131. Two of the flexible polyurethane block members 1103 are secured at their forward ends to the rearwardly facing surface 1131 of each snow plow section 1125 about midway between the upper edge thereof and the lower edge thereof, and are secured at their rearward ends to the upper horizontal bar 1108. Two additional flexible polyurethane block members 1103 are secured at their forward ends to the rearwardly facing surface 1131 of each snow plow section 1125 near the lower edge thereof, and are secured at their rearward ends to the lower horizontal bar 1110.

The flexible polyurethane block members 1103 are secured to the rearward facing surface 1131 of the moldboard 1100 by upper and lower mounting plates 1107*a*, 1107*b*, which are secured to the moldboard, and by upper (hidden) and lower capture plates 1109, which receive the forward end of the flexible polyurethane block members 1103 between the mounting plates 1107*a*, 1107*b* and capture plates 1109. The forward end of each flexible polyurethane block members 1103 is thus sandwiched and held in place to the back of the moldboard 1100 by securing a bolt through the mounting plate, the flexible polyurethane block and the capture plate. The rearward end of each polyurethane block members 1103 is similarly secured to the snow plow frame 1112.

The hinged torsion-spring trip cutting edge assembly 1199 consists of left and right tabs 1117*a*, 1117*b*. The tabs 1117*a*, 1117*b* are welded directly to the rearwardly facing surface 1131 of the moldboard 1100 and located below each lower mounting plate 1107*b*. Located on each side of each tab are apertures 1113. The bottom portion of tabs 1117*a*, 1117*b* is welded to the top portion of angle iron 1121, which spans the length of the lower edge of the moldboard 1100. Bolted to the length of the angle iron 1121 is a steel cutting edge 1123.

A first torsion spring 1105*a* is placed within left tab 1117*a* and a first steel rod 1111*a* is inserted through the apertures 1113 of the left tab 1117*a* and the torsion spring 1105*a*, connecting the angle iron 1121 to the moldboard 1100. Similarly, a second torsion spring 1105*b* is placed within right tab 1117*b* and a second steel rod 1111*b* is inserted through the apertures 1113 of the right tab 1117*b* and the torsion spring 1105*b*, connecting the angle iron 1121 to the moldboard 1100. Additionally, a third torsion spring 1105*c* is secured to the moldboard 1100 and the angle iron 1121, and is equidistantly located between left tab 1117*a* and right tab 1117*b*.

In operation, when the moldboard 1100 impacts an obstacle, the hinged torsion spring trip cutting edge folds backwards, exceeding an angle of 45 degrees, so as to cause the cutting edge 1123 to push the moldboard assembly upward and allowing the snow plow to clear the obstacle in the road. Once the obstacle is cleared, the hinged torsion spring trip cutting edge will go back to its original starting position.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. A slip hitch assembly for use with a snow plow having a snow plow frame, an upper horizontal edge, a lower horizontal edge, and arcuate wall means therebetween for contact with and movement of snow, said slip hitch assembly comprising:

first vertical connecting member means for supporting a first elongated slip hitch member thereon for limited reciprocal movement upwardly and downwardly relative thereto as said snow plow is moved upwardly and downwardly, including said first elongated slip hitch member, said first elongated slip hitch member mounted on said first vertical connecting member means, said first elongated slip hitch member including first connecting hook member means for connection to a forward drive vehicle for moving said snow plow forward during its snow plowing operation;

second vertical connecting member means for supporting a second elongated slip hitch member thereon for limited reciprocal movement upwardly and downwardly relative thereto as said snow plow is moved upwardly and downwardly, including said second elongated slip hitch member, said second elongated slip hitch member mounted on said second vertical connecting member means, said second elongated slip hitch member including second connecting hook member means for connection to a forward drive vehicle for moving said snow plow forward during its snow plowing operation;

said first elongated slip hitch member including an upper end and a lower end, said first connecting hook member means at its upper end facing rearwardly for connection to said forward drive vehicle, an upper flat planar section of first elongated slip hitch member extending downwardly therefrom to terminate at said lower end of said first elongated slip hitch member, an elongated upper guide slot provided through said upper flat planar section, an elongated lower guide slot provided through said lower flat planar section, an integrally formed flat planar forward projecting section of said first elongated slip hitch member extending forwardly thereof at a location between said upper and lower guide slots, an integrally formed flat planar rearward projecting section of said first elongated slip hitch member extending rearwardly thereof at its said lower end, and an aperture through said flat planar rearward projecting section;

said second elongated slip hitch member including an upper end and a lower end, said second connecting hook member means at its upper end facing rearwardly for connection to said forward drive vehicle, an upper flat planar section of second elongated slip hitch member extending downwardly therefrom to terminate at said lower end of said second elongated slip hitch member, an elongated upper guide slot provided through said upper flat planar section, an elongated lower guide slot provided through said lower flat planar section, an integrally formed flat planar forward projecting section of said second elongated slip hitch member extending forwardly thereof at a location between said upper and lower guide slots, an integrally formed flat planar rearward projecting section of said second elongated slip hitch member extending rearwardly thereof at its said lower end, and an aperture through said flat planar rearward projecting section;

a snow plow having a snow plow frame, said snow plow frame having an upper laterally extending bar and a lower laterally extending bar;

adjustable slide mount means connected to said snow plow frame for accommodating different manufacturers' boom spread size;

said first vertical connecting member means being adjustably secured to said adjustable slide mount means; and said second vertical connecting member means being adjustably secured to said adjustable slide mount means at a location spaced apart horizontally from said first vertical connecting member means;

said adjustable slide mount means including a first upper and lower slotted steel channel for adjustably receiving said first vertical connecting member means;

said adjustable slide mount means further including a second upper and lower slotted steel channel for adjustably receiving said second vertical connecting member means;

each of said first and second upper slotted steel channels being mounted on said upper laterally extending bar, each of said first and second lower slotted steel channels being mounted on said lower laterally extending bar;

said snow plow frame being connected to a moldboard, said moldboard including spring means for connecting a cutting edge to said moldboard so as to allow said moldboard to fold backwards upon encountering an obstacle in the roadway and to return said moldboard to its original position after clearing the obstacle;

first wing plate assembly means connected to said upper and lower laterally extending bars of said frame on one side thereof for capturing snow as the snow plow is moved in the forward and reverse directions and for preventing the aft portion thereof from being pushed inwardly;

second wing plate assembly means connected to said upper and lower laterally extending bars of said frame on the other side thereof for capturing snow as the snow plow is moved in the forward and reverse directions and for preventing the aft portion thereof from being pushed inwardly;

each of said first and second wing plate assembly means includes a skid shoe;

a first reinforcing bracket interconnected with said first wing plate assembly and said upper and lower laterally extending bars, said first reinforcing bracket including an L-shaped member, said L-shaped member having a top portion, a bottom portion and three vertically aligned apertures, said top portion joined to a top triangular member, said bottom portion joined to a bottom triangular member; and a second reinforcing bracket interconnected with said second wing plate assembly and said upper and lower laterally extending bars, said first reinforcing bracket including an L-shaped member, said L-shaped member having a top portion, a bottom portion and three vertically aligned apertures, said top portion joined to a top triangular member, said bottom portion joined to a bottom triangular member.

2. A slip hitch assembly as claimed in claim 1, wherein each of said first and second wing plate assembly means includes a first arcuate slot, a second arcuate slot, a circular opening, and a reinforcing bracket.

3. A slip hitch assembly as claimed in claim 2, wherein said first arcuate slot in said first and second wing plate assembly means are in registration with said upper laterally extending bar, a first bolt extending through said first arcuate slot and being threadedly received in a corresponding first threaded recess in said upper laterally extending bar in registration with said first arcuate slot, said circular opening in said first and second wing plate assembly means being in registration with said lower laterally extending bar, a second bolt extending through said circular opening and being threadedly received in a corresponding second threaded recess in said lower laterally extending bar in registration with said circular opening, said reinforcing bracket being connected to said snow plow frame on each side thereof, and said second arcuate slot in said first and second wing plate assembly means in registration with a first corresponding aperture in said corresponding reinforcing bracket, a third bolt extending through said second arcuate slot and said first corresponding aperture in said corresponding reinforcing bracket received in a corresponding first nut.

4. A slip hitch assembly as claimed in claim 1, wherein said skid shoe includes a flat portion, an upwardly inclined forward portion and an upwardly inclined back portion.

5. A slip hitch assembly as claimed in claim 1, wherein said snow plow comprises a plurality of independently, vertically movable snow plow sections.

* * * * *